US006694942B1

(12) United States Patent
Massmann et al.

(10) Patent No.: US 6,694,942 B1
(45) Date of Patent: Feb. 24, 2004

(54) FOUR-STROKE ENGINE WITH ROTARY VALVE CONTROL

(75) Inventors: Rainer Massmann, Hamburg (DE); Bernhard Auler, Hamburg (DE); Wolf Burger, Böblingen (DE)

(73) Assignee: Dolmar GmbH, Hamburg (DE)

( * ) Notice: Subject to any disclaimer, the term of this patent is extended or adjusted under 35 U.S.C. 154(b) by 1 day.

(21) Appl. No.: 10/130,006

(22) PCT Filed: Oct. 31, 2000

(86) PCT No.: PCT/EP00/10753

§ 371 (c)(1),
(2), (4) Date: May 9, 2002

(87) PCT Pub. No.: WO01/38705

PCT Pub. Date: May 31, 2001

(30) Foreign Application Priority Data

Nov. 25, 1999 (DE) ..... 299 20 719 U

(51) Int. Cl.[7] ..... F01L 7/00
(52) U.S. Cl. ..... 123/190.8; 123/80 BA
(58) Field of Search ..... 123/190.2, 190.8, 123/80 BA, 73 B, 73 C

(56) References Cited

U.S. PATENT DOCUMENTS 4,506,636 A * 3/1985 Negre et al. ..... 123/190.2
4,944,261 A * 7/1990 Coates ..... 123/190.14
5,526,780 A * 6/1996 Wallis ..... 123/190.6
5,941,206 A * 8/1999 Smith et al. ..... 123/190.4
6,237,556 B1 * 5/2001 Smith et al. ..... 123/190.8

FOREIGN PATENT DOCUMENTS

| | | | |
|---|---|---|---|
| CH | 154282 | 7/1932 | |
| DE | 42 20 200 A1 | 1/1993 | ..... F02B/33/26 |
| FR | 478308 | 12/1915 | |
| GB | 2 190 139 A | 11/1987 | ..... F01L/7/02 |

* cited by examiner

*Primary Examiner*—Henry C. Yuen
*Assistant Examiner*—Douglas A Salser
(74) *Attorney, Agent, or Firm*—McCormick, Paulding & Huber LLP

(57) ABSTRACT

The invention aims to provide a compact four-stroke engine with rotary valve control and petroil lubrication which has a simplified construction and allows the engine to be used in any position as a result of an improved lubrication system. To this end, the carburetor is directly connected to the inlet opening and the rotary valve is configured in such a way that in a first position it connects the carburetor to the combustion chamber, in a second position it connects the carburetor to the cylinder chamber/crankcase via the overflow conduit and in a third position it connect the cylinder chamber/crankcase to the combustion chamber via the overflow conduit and the combustion chamber to the outlet opening via the conduit. Said rotary valve is in continuous motion during the operation of the combustion engine and the first, second and third positions only occur at corresponding defined moments.

5 Claims, 6 Drawing Sheets

FOUR-STROKE ENGINE WITH ROTARY VALVE CONTROL

CROSS-REFERENCE TO RELATED APPLICATIONS

This application is entitled to the benefit of and incorporates by reference essential subject matter disclosed in International Application No. PCT/EP00/10753 filed on Oct. 31, 2000 and German Patent Application No. 299 20 719.6 filed on Nov. 25, 1999.

TECHNICAL FIELD

This invention concerns a compact four-cycle internal combustion engine according to the preamble of claim 1.

PRIOR ART

Such an engine which works with a mixture lubrication and which is appropriate in particular for being used in a portable working device, for example a motor scythe or a motor saw, is known from the printed document DE-A1-42 20 200.

From the prior art, we know a four-cycle internal combustion engine with oil lubrication, the oil being separately stored from the fuel. The oil is purposefully delivered to the corresponding lubrication points, or it comes from an oil sump as an oil-air mixture (oil mist) to the lubrication points.

An engine lubrication with a fuel-oil-air mixture, similar to the lubrication of two-cycle engines, is also known. The fuel-oil-air mixture is preliminarily stored in the crankcase and supplied to the rotary valve inlet over a duct. A flowing back of the mixture into the carburetor is avoided by a diaphragm valve (see the printed document DE-A1-42 20 200 mentioned in the introduction).

A disadvantage of such a rotary valve controlled lubrication system is that the whole fuel-oil-air mixture flows over a relatively long path through the crankcase, although only a comparatively slight part of the mixture is required for the lubrication in the area of the crankcase. But it is also disadvantageous that an additional valve mechanism must be provided between the crankcase and the carburetor, whereby this mechanism causes an increasement of costs and can be, as an additional functional element, a further source of trouble during the operation.

Representation of the Invention, Aim, Solution, Advantages

Thus, the aim of the invention is to create a compact four-cycle internal combustion engine with rotary valve control and mixture lubrication which is characterized by a simplified assembly and which, due to an improved lubrication, allows in particular an operation independently from the position.

This aim is achieved by the whole characteristics of claim 1. The heart of the invention consists in the control not only of the filling and discharging of the combustion chamber but also in the guiding of a part of the mixture temporarily into the combined cylinder/crankcase chamber and then in the flowing back again out of the cylinder/crankcase chamber for filling the combustion chamber. The combustion chamber is filled mainly directly by the mixture coming from the carburetor. The additional mixture coming from the crankcase chamber assists the filling. Thus, it is possible to guarantee an adapted position independent lubrication simultaneously with a compact assembly and short duct ways. Moreover, a recharging effect is achieved by the additionally supplied mixture from the crankcase chamber.

The assembly is particularly space saving when, according to a preferred embodiment of the invention, the rotary valve is placed in the cylinder head and when the rotary valve is driven by the crankshaft over a gear which preferably comprises two toothed wheels and a toothed belt.

Preferably, the rotary valve comprises a cylindrical body in which two channels and a recess are provided for realizing the connections. The channels can also be realized as a recess and the recess as channels. The body is not necessarily cylindrical, other forms such as balls or crowned bodies are also possible.

SHORT DESCRIPTION OF THE DRAWINGS

The invention will be explained in detail below by means of examples of embodiments with reference to the attached drawings.

Figure 2:
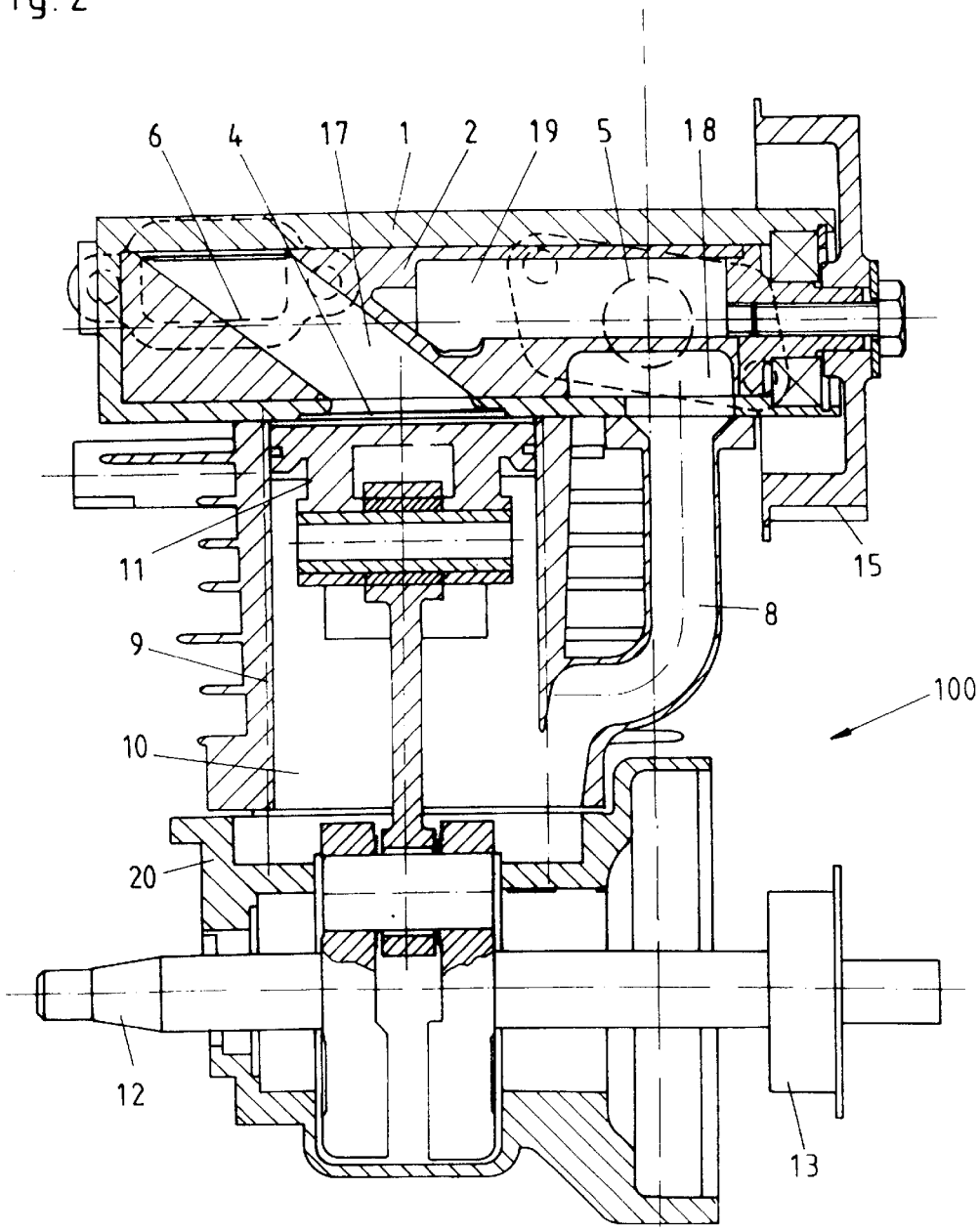
FIG. 2 shows the engine of FIG. 1 in an exploded section representation.
Figure 4:
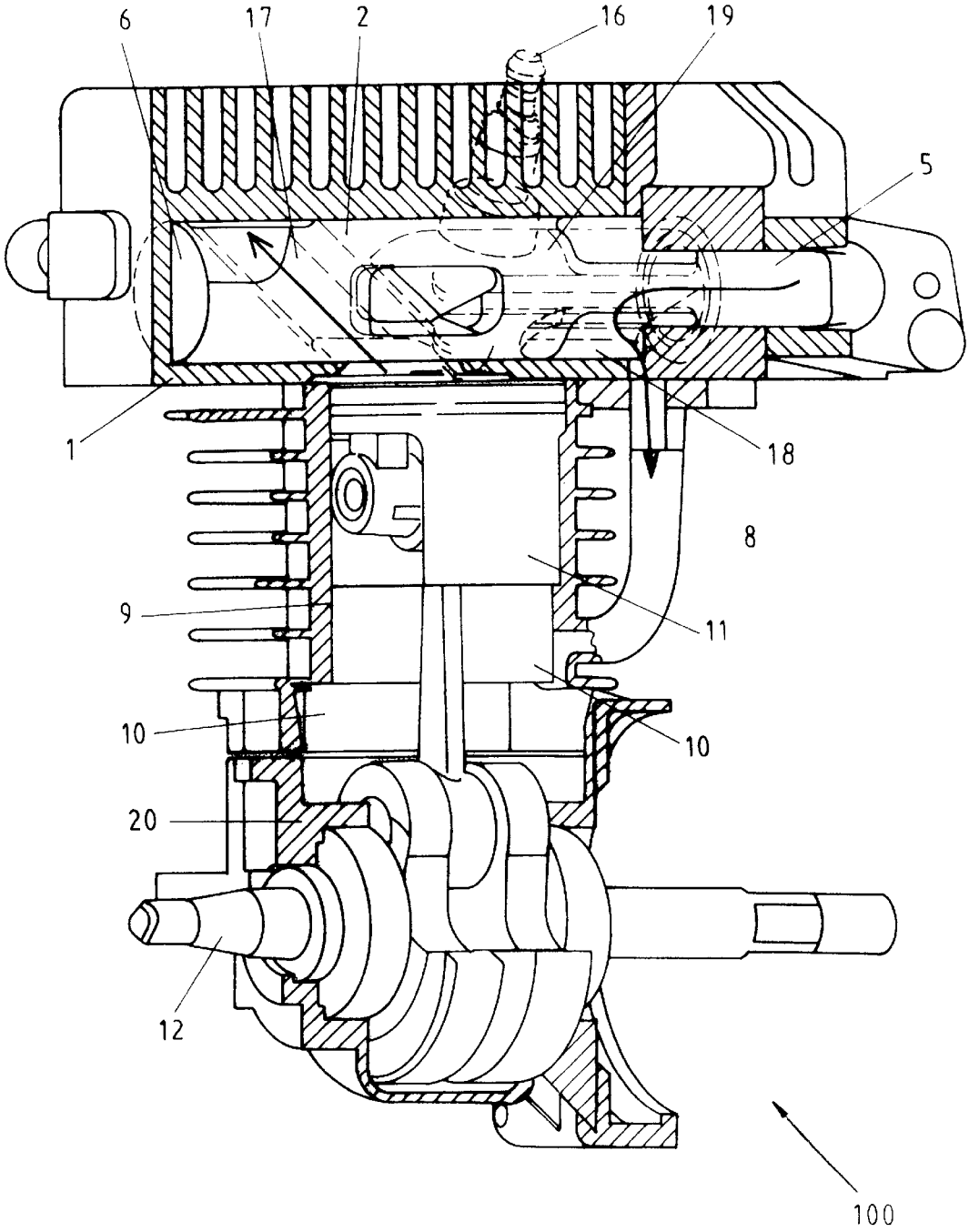
Figure 5:
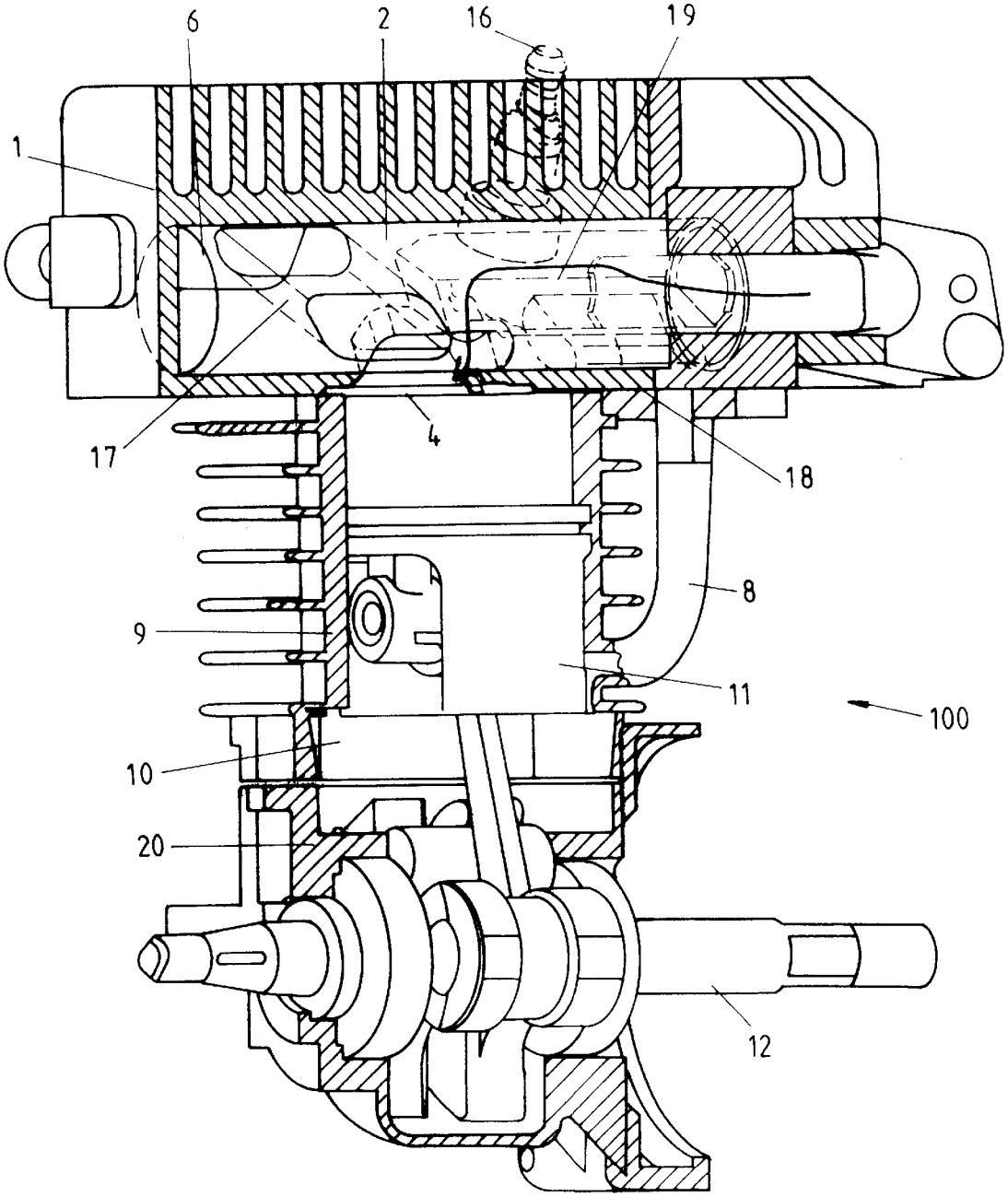
Figure 6:
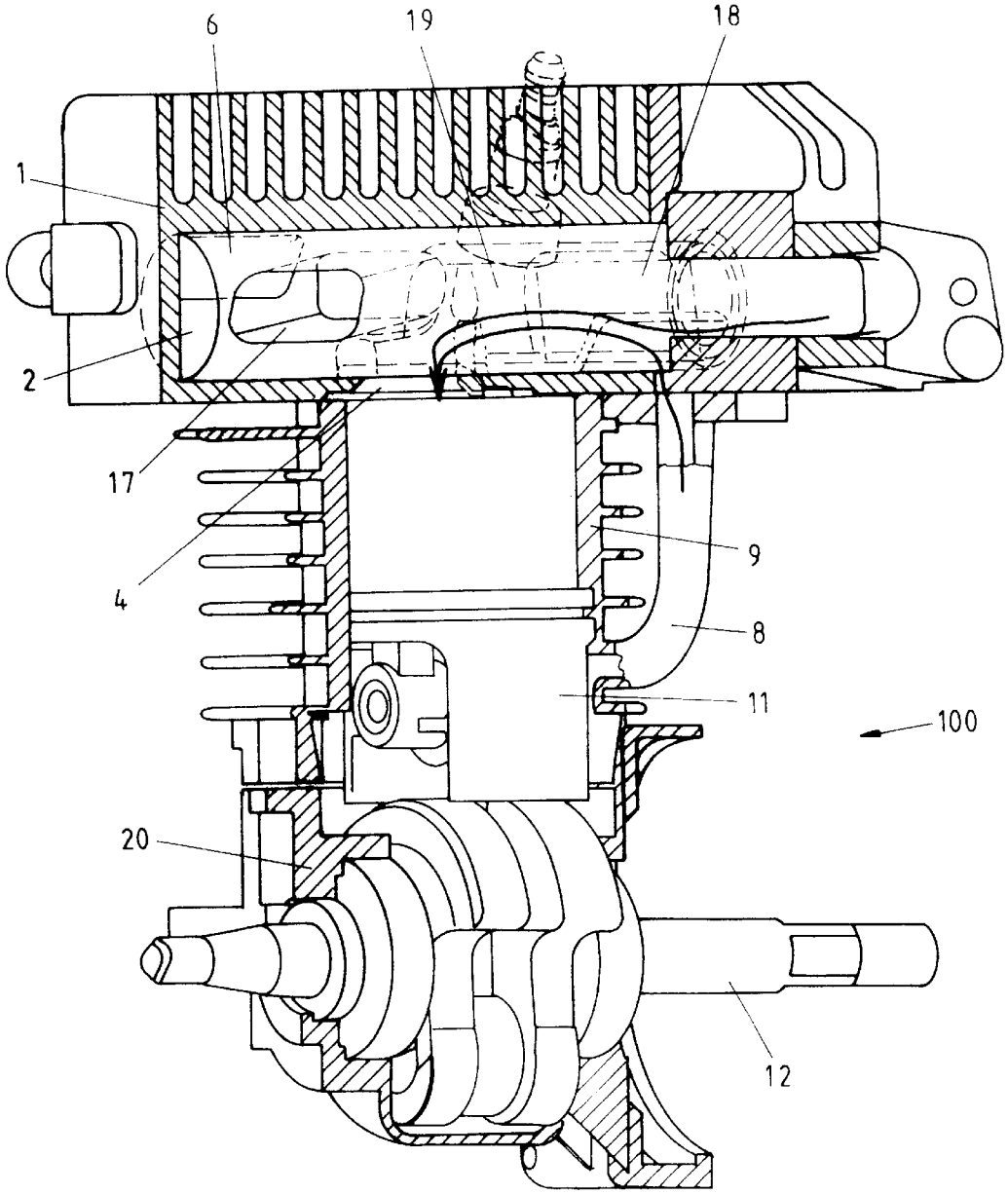

FIGS. 4 to 6 show in perspective longitudinal sections four different phases during the operation of the engine according to FIG. 2 which differ from each other respectively about a crankshaft angle of 90°, whereby FIG. 4 refers to the position of the piston in the upper dead center and FIG. 6 to the position of the piston in the bottom dead center (B.D.C.) and FIG. 5 and 6 show respectively the piston position of 90° after or before the upper dead center. It concerns here continuous courses; the representation of the different positions constitutes respectively only one precise moment.

BEST WAY FOR CARRYING OUT THE INVENTION

Figure 1:
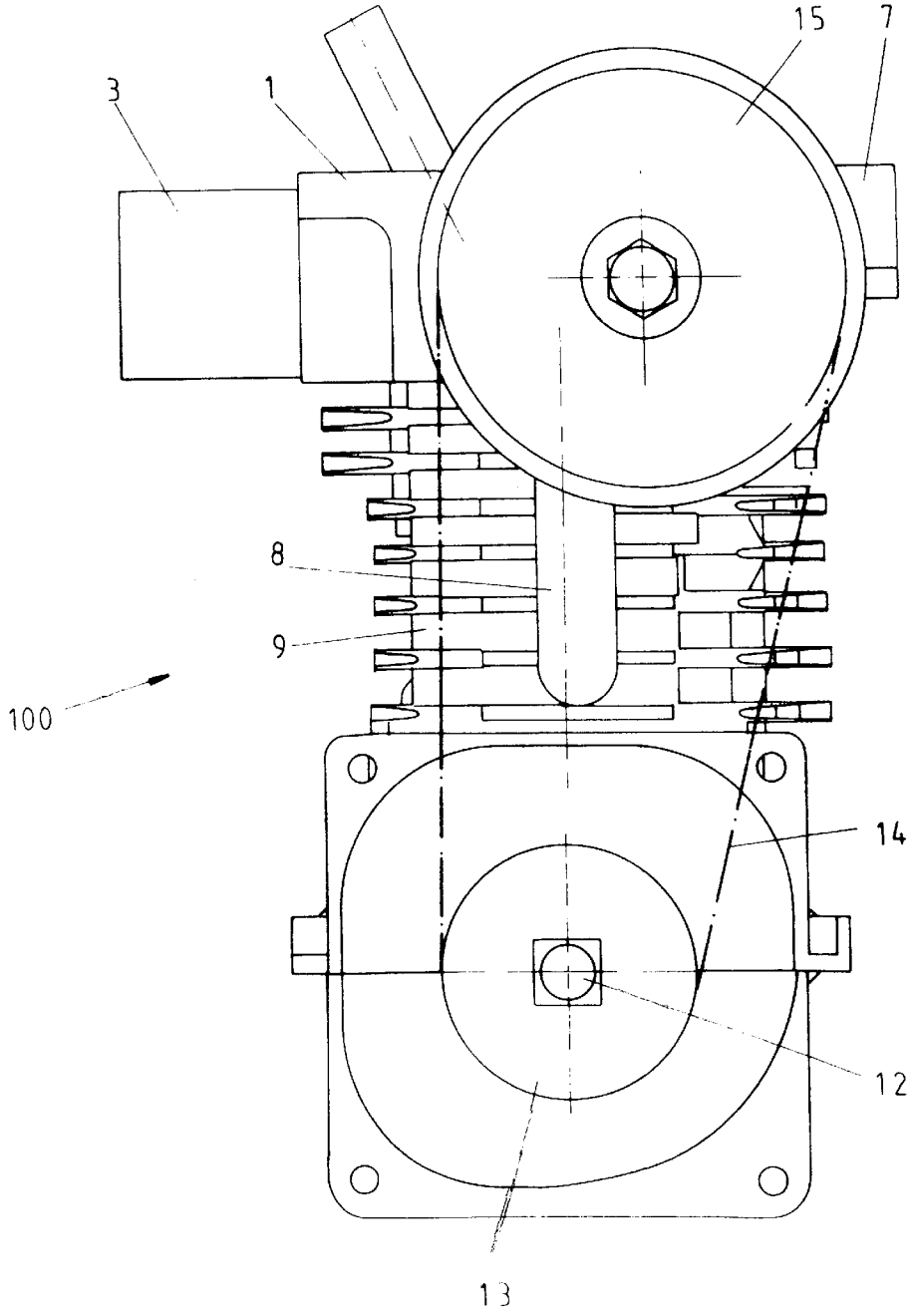
FIG. 1 shows a preferred embodiment of a four-cycle internal combustion engine according to the invention in a side view of the actuation of the rotary valve.
Figure 3:
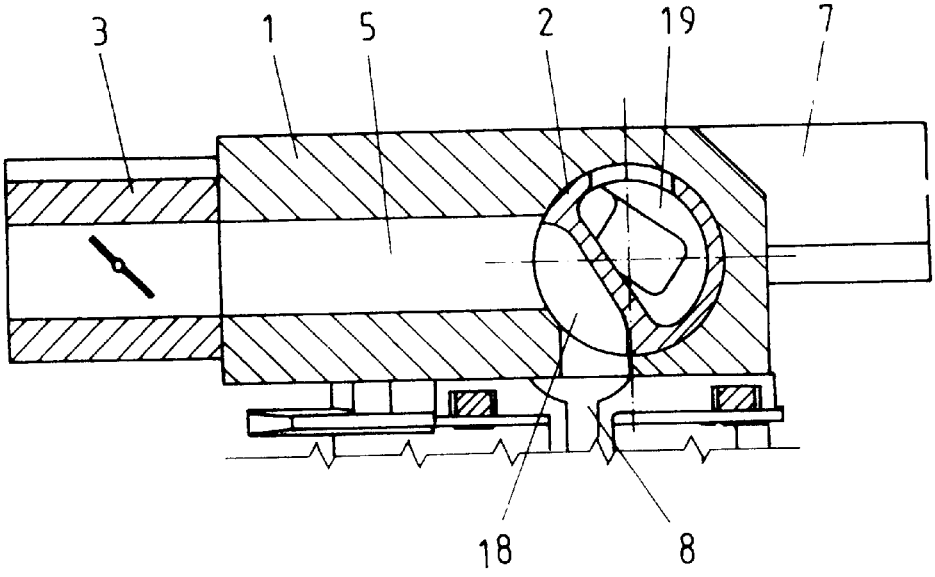
FIG. 3 shows in a cutout a cross section through the rotary valve of the engine of FIG. 2 positioned in the cylinder head.

The four-cycle internal combustion engine 100, which is represented in FIGS. 1 to 3 as the preferred embodiment of the invention, substantially consists of a cylinder 9 with a piston 11 sliding up and down therein as well as with a crankcase 20 which is connected at the bottom to the cylinder 9, whereby the crankcase 20 and the cylinder 9 can also be made of one piece, and of a cylinder head 1 with a combustion chamber 4 which is connected on the top to the cylinder 9, whereby the cylinder 9 and the cylinder head 1 can also be made of one piece. A cylindrical rotary valve 2 is placed in the cylinder head 1, the rotary valve having several control openings: an inlet opening 5 to a carburetor 3, an outlet opening 6 to an outlet channel 7 and an opening to an overflow duct with a connection to the cylinder 9 as well as an opening to the combustion chamber 4. In the rotary valve 2, two channels 17 and 19 as well as a recess 18 are placed in such a way that connections are made between the carburetor 3 and the combustion chamber 4, the carburetor 3 and the cylinder 9, the cylinder 9 and the combustion chamber 4 as well as the combustion chamber 4 and the outlet channel 7 depending on the rotation angle of the rotary valve 2. The lubrication is carried out by a fuel-oil-air mixture which is produced in the carburetor 3 in a way known in itself.

The following gas flows are controlled by the control openings of the rotary valve 2:

suction/admission in of the fuel-oil-air mixture from the carburetor 3 into the combustion chamber 4; the rotary valve 2 connects the inlet opening 5 with the combustion chamber 4 over the channel 19 (FIG. 5).

suction of the fuel-oil-air mixture from the carburetor 3 into the cylinder/crankcase chamber 10; the rotary valve 2 connects the inlet opening 5 to the overflow duct 8 over the recess 18 (FIGS. 4 and/or FIG. 6).

reloading into the combustion chamber 4 by the fuel-oil-air mixture preliminary stored in the crankcase 20 during the operating cycle; the rotary valve 2 connects the overflow duct 8 to the combustion chamber 4 over the channel 19 (FIG. 6).

discharging of the exhaust gas from the combustion chamber 4 through the outlet channel 7; the rotary valve 2 connects the combustion chamber 4 with the outlet opening 5 over the channel 17 (FIGS. 4 and/or FIG. 6).

In accordance to FIGS. 4 to 6, the time history is the following:

The piston 11 is in the upper dead center (gas exchange upper dead center) and produces a depression in the upper area of the cylinder 9 during the downward movement so that the fuel-oil-air mixture flows from the carburetor 3 into the combustion chamber 4 (movement of FIG. 4→FIG. 5). Still before the piston 11 reaches the lower dead center, the connection between the overflow duct 8 and the combustion chamber 4 is made so that the fuel-oil-air mixture preliminarily stored in the crankcase 20 can additionally flow into the combustion chamber 4 (FIG. 6). During the subsequent upward movement of the piston 11 with the ignition of the mixture by the ignition plug 16 and the following downward movement, the control openings to the cylinder 9/crankcase space 10 and combustion chamber 4 remain closed. At the lower dead center, the connection to the outlet (6, 7) is made so that the piston 11 can push the exhaust gas out of the cylinder 9 (movement of FIG. 6→FIG. 4). Simultaneously, the overflow duct 8 and the inlet opening 5 are freed so that the mixture is sucked by the piston movement from the carburetor 3 into the cylinder 9/crankcase chamber 10. At the upper dead center, the outlet (6, 7) and the overflow duct 8 are closed again (FIG. 4). The rotary valve 2 can then be driven over a belt gearing, a chain gearing, a toothed gearing or the like by the crankshaft 12. In the represented embodiment, a driving gear which comprises two toothed wheels 13, 15 and a toothed belt 14 is used (FIG. 1).

List of Reference Numerals

100 Four-cycle internal combustion engine
1 Cylinder head
2 Rotary valve
3 Carburetor
4 Combustion chamber
5 Inlet opening
6 Outlet opening
7 Discharge channel
8 Overflow duct
9 Cylinder
10 Cylinder/crankcase chamber
11 Piston
12 Crankshaft
13,15 Driving wheel (rotary valve)
14 Toothed belt
16 Ignition plug
17 Channel
18 Recess
19 Channel
20 Crankcase

What is claimed is:

1. A four-cycle internal combustion engine comprising a piston which moves up and down in a cylinder, a crankshaft which is rotatably positioned in a crankcase connected with the cylinder or made of one piece and which is set rotating by the up and down movement of the piston, a cylinder head which terminates the cylinder on the top and which forms a combustion chamber, a rotary valve, controlled by the crankshaft, which connects the combustion chamber optionally with an inlet opening or with an outlet opening, a carburetor for constituting a lubrication fuel-oil-air mixture as well as an overflow duct through which the cylinder/crankcase chamber can be connected with the combustion chamber over the rotary valve, characterized in that the carburetor is directly connected with the inlet opening and that the rotary valve is configured in such a way that in a first position, it connects the carburetor with the combustion chamber, that in a second position, it connects the carburetor over the overflow duct with the cylinder/crankcase chamber and that in a third position, it connects the cylinder/crankcase chamber over the overflow duct with the combustion chamber and the combustion chamber over the channel with the outlet opening, whereby the rotary valve is continuously moving during the operation of the internal combustion engine and that the first, second and third position exist only at a respectively precise moment.

2. A four-cycle internal combustion engine, characterized in that the rotary valve is placed in the cylinder head.

3. A four-cycle internal combustion engine according to claim 1, characterized in that the rotary valve is driven by the crankshaft over a gear.

4. A four-cycle internal combustion engine according to claim 3, characterized in that the gear comprises two toothed wheels and a toothed belt.

5. A four-cycle internal combustion engine according to claim 1, characterized in that the rotary valve comprises a preferably cylindrical body in which two channels and a recess are provided for constituting the connections.

* * * * *

UNITED STATES PATENT AND TRADEMARK OFFICE

CERTIFICATE OF CORRECTION

PATENT NO. : 6,694,942 B1
DATED : February 24, 2004
INVENTOR(S) : Rainer Massmann et al.

It is certified that error appears in the above-identified patent and that said Letters Patent is hereby corrected as shown below:

Title page,
Item [57], ABSTRACT,
Line 10, after "it", please delete "connect" and insert -- connects --.

Signed and Sealed this

Sixth Day of July, 2004

JON W. DUDAS
*Acting Director of the United States Patent and Trademark Office*